US006186865B1

(12) United States Patent
Thornton et al.

(10) Patent No.: US 6,186,865 B1
(45) Date of Patent: Feb. 13, 2001

(54) APPARATUS AND METHOD FOR PERFORMING END POINT DETECTION ON A LINEAR PLANARIZATION TOOL

(75) Inventors: Brian Thornton, Fremont; Andrew J. Nagengast; Robert G. Boehm, Jr., both of Sunnyvale; Anil K. Pant, Santa Clara; Wilbur C. Krusell, Palo Alto, all of CA (US)

(73) Assignee: Lam Research Corporation, Fremont, CA (US)

( * ) Notice: Under 35 U.S.C. 154(b), the term of this patent shall be extended for 0 days.

(21) Appl. No.: 09/182,532

(22) Filed: Oct. 29, 1998

(51) Int. Cl.[7] ..... B24B 7/22
(52) U.S. Cl. ..... 451/8; 451/307
(58) Field of Search ..... 451/288, 287, 451/8, 41, 307, 303, 173, 5

(56) References Cited

U.S. PATENT DOCUMENTS

| | | |
|---|---|---|
| 4,793,895 | 12/1988 | Kaanta et al. . |
| 5,078,801 | 1/1992 | Malik . |
| 5,240,552 | 8/1993 | Yu et al. . |
| 5,265,378 | 11/1993 | Rostoker . |
| 5,272,117 | 12/1993 | Roth et al. . |

(List continued on next page.)

FOREIGN PATENT DOCUMENTS

WO 85/04486 10/1985 (WO) .

OTHER PUBLICATIONS

Chingfu Lin, Shie–Sen Peng, Hsin Chu, "Pad Temperature As An End Point Detection Method in WCMP Process," 1998 CMP MIC Conference, Feb. 19–20, 1998, pp. 52–56.

"Zeta Potential: A Complete Course in 5 Minutes," Zeta–Meter, Inc. brochure, pp. 1–8.

"Coulter Delsa 440 SX, Zeta Potential and Particle Size," Coulter International Corp., 1996–1998, pp. 1–3.

D.H. Everett, Basic Principles of Colloid Science, Chapter 6, "Some Important Properties of Colloids I Kinetic Properties," Royal Society of Chemical Paperbacks, Thomas Graham, Cambridge, CB4 4WF, pp. 76–79 and 88–91.

Denny A. Jones —2$^{nd}$ed., Principles and Prevention of Corrosion, Chapter 2, "Thermodynamics and Electrode Potential," ISBN 0–13–359993–0, Prentice–Hall International, 1996.

Diane Hymes, Igor Malik, Jackie Zhang, Ramin Emami, "Brush scrubbing emerges as future wafer–cleaning technology," Solid State Technology, 0038–111X, Jul. 1997, pp. 209–214.

Brad Withers, Eugene Zhao, Wilbur Krusell, Rahul Jairath, "Wide Margin CMP for STI," Solid State Technology, Jul. 1996, pp. 173–179.

D.R. Crow, 4$^{th}$ed., Principles and Applications of Electrochemistry, ISBN 0 7514 0158 4 (PB), Blackie Academic and Professional, 1994, pp. 76–77.

R.J. Gutmann, D.T. Price, J.M. Neirynck, C. Sainio, D. Permana, D.J. Duquette And S.P. Murarka, "CMP of Copper–Polymer Interconnect Structures," CMP–MIC Conference, 1998 IMIC–300P/98/0257, Feb. 19–20, 1998, pp. 257–266.

*Primary Examiner*—Robert A. Rose
(74) *Attorney, Agent, or Firm*—Brinks Hofer Gilson & Lione

(57) ABSTRACT

A technique for utilizing a sensor to monitor fluid pressure from a fluid bearing located under a polishing pad to detect a polishing end point. A sensor is located at the leading edge of a fluid bearing of a linear polisher, which is utilized to perform chemical-mechanical polishing on a semiconductor wafer. The sensor monitors the fluid pressure to detect a change in the fluid pressure during polishing, which change corresponds to a change in the shear force when the polishing transitions from one material layer to the next.

30 Claims, 4 Drawing Sheets

U.S. PATENT DOCUMENTS

| | | | | |
|---|---|---|---|---|
| 5,308,438 | | 5/1994 | Cote et al. . | |
| 5,321,304 | | 6/1994 | Rostoker . | |
| 5,329,732 | | 7/1994 | Karlsrud et al. . | |
| 5,409,544 | | 4/1995 | Ota et al. . | |
| 5,433,651 | | 7/1995 | Lustig et al. . | |
| 5,527,423 | | 6/1996 | Neville et al. . | |
| 5,558,568 | | 9/1996 | Talieh et al. . | |
| 5,593,344 | | 1/1997 | Weldon et al. . | |
| 5,668,063 | * | 9/1997 | Fry et al. | 438/5 |
| 5,692,947 | | 12/1997 | Talieh et al. . | |
| 5,722,877 | * | 3/1998 | Meyer et al. | 451/307 |
| 5,762,536 | * | 6/1998 | Pant et al. . | |
| 5,800,248 | | 9/1998 | Pant et al. . | |
| 5,944,580 | * | 8/1999 | Kim et al. | 451/288 |
| 5,980,368 | * | 11/1999 | Chang et al. | 451/303 |

* cited by examiner

APPARATUS AND METHOD FOR PERFORMING END POINT DETECTION ON A LINEAR PLANARIZATION TOOL

RELATED APPLICATION

This application is related to co-pending application titled "Use Of Zeta Potential During Chemical Mechanical Polishing For End Point Detection;" Ser. No. 09/182,570; filed Oct. 29, 1998.

BACKGROUND OF THE INVENTION

1. Field of the Invention

The present invention relates to the field of semiconductor wafer processing and, more particularly, to performing end-point detection on a linear planarization tool used to planarize semiconductor wafers.

2. Background of the Related Art

The manufacture of an integrated circuit (IC) device requires the formation of various layers above a base semiconductor substrate, in order to form embedded structures over or in previous layers formed on the substrate. During the manufacturing process, certain portions of these layers need complete or partial removal to achieve the desired device structure. With diminishing feature size, such structures result in highly irregular surface topography causing manufacturing problems in the formation of thin film layers. To facilitate manufacturing processes, the rough surface topography has to be smoothened or planarized.

One of the methods for achieving planarization of the surface is chemical mechanical polishing (CMP). CMP is being extensively pursued to planarize a surface of a semiconductor wafer, such as a silicon wafer, at various stages of integrated circuit processing. CMP is also used in flattening optical surfaces, metrology samples, and various metal and semiconductor based substrates.

CMP is a technique in which a chemical slurry is used along with a polishing pad to polish away materials on a semiconductor wafer. The mechanical movement of the pad relative to the wafer, in combination with the chemical reaction of the slurry disposed between the wafer and the pad, provide the abrasive force with chemical erosion to planarize the exposed surface of the wafer (typically, a layer formed on the wafer), when subjected to a force pressing the wafer onto the pad. In the most common method of performing CMP, a substrate is mounted on a polishing head which rotates against a polishing pad placed on a rotating table (see, for example, U.S. Pat. No. 5,329,732). The mechanical force for polishing is derived from the rotating table speed and the downward force on the head. The chemical slurry is constantly transferred under the polishing head. Rotation of the polishing head helps in the slurry delivery, as well as in averaging the polishing rates across the substrate surface.

Another technique for performing CMP to obtain a more effective polishing rate is using the linear planarization technology. Instead of a rotating pad, a moving belt is used to linearly move the pad across the wafer surface. The wafer is still rotated for averaging out the local variations, but the planarization uniformity is improved over CMP tools using rotating pads, partly due to the elimination of unequal radial velocities. One such example of a linear polisher is described in U.S. Pat. No. 5,692,947.

Unlike the hardened table top of a rotating polisher, linear planarizing tools are capable of using linearly moving belts upon which the pad is disposed. The ability for the belt to flex can cause a change in the pad pressure being exerted on the wafer. When the pressure of the wafer-pad engagement can be controlled, it provides a mechanism for adjusting the planarization rate and/or the polishing profile across the surface of the wafer. Therefore, a fluid support (or platen) can be placed under the belt for use in adjusting the pad pressure being exerted on the wafer. An example of a fluid support is disclosed in U.S. Pat. No. 5,558,568.

When CMP is employed, it is generally advantageous to monitor the effects of the planarizing process to determine if the process is being performed according to desired specifications. A monitoring problem specific to CMP is the determination of the process end point. That is, the ability to monitor the material thickness being removed and to terminate the polishing when a certain end point condition is reached. A typical end point is the case when one material is removed to exposed an underlying material, which is different from the first material. An end point detection technique detects this point where the CMP process is to be stopped.

Various schemes have been devised to detect an end point during CMP. For example, one technique relies on conductivity measurements (see for example, U.S. Pat. Nos. 4,793,895 and 5,321,304). Another technique employs the monitoring of the electrical current to a motor which rotates the wafer (see for example, U.S. Pat. No. 5,308,438). Still another technique uses an acoustic wave reflection to monitor dielectric thickness (see for example, U.S. Pat. No. 5,240,552). Optical techniques are now being implemented as an accurate indicator for measuring material thickness on a wafer (see for example, U.S. Pat. No. 5,433,651). Additionally, Chingfu Lin et al. have demonstrated the use of pad temperature as a method for the determination of polish end point (see, "Pad Temperature As An End Point Detection Method in WCMP Process;" 1998 CMP-MIC Conference; Feb. 19–20, 1998; pp. 52–56). Accordingly, it is understood that a number of techniques are available for detecting the end point of a polishing cycle for a semiconductor wafer.

The historical approaches for in-situ monitoring of the end point pertains mainly to rotating (orbital) polishers. Linear polishing techniques allow for alternative techniques to be developed to take advantage of the linearly moving pad/belt of the linear planarization tools. The present invention implements an end point detection scheme for CMP, which relies on an operative phenomenon different from previous techniques, but is still simple in its approach. The present invention is operative with linear planarization tools, but can be readily adapted to other techniques, including rotating polishers.

SUMMARY OF THE INVENTION

The present invention describes a technique for monitoring fluid pressure from a fluid bearing located under a polishing pad to detect a polishing end point. In the specific embodiment, a linear polisher, which employs a fluid bearing, is utilized to perform chemical-mechanical polishing on a semiconductor wafer. At least one sensor is distributed along the surface or coupled to an opening along the surface to determine the pressure of the fluid residing between the surface of the fluid bearing and the underside of the belt/pad assembly. In the preferred technique, the sensor is located at the leading edge where a point on the pad first engages the wafer.

The leading edge pressure sensor is used to detect a change in the fluid pressure during a polishing step. When one material is polished away to expose a second material, the shear force being exerted at the wafer-pad interface changes, causing a corresponding change in the fluid pressure being sensed by the pressure sensor. This pressure response is translated into a pressure curve, which is used to determine the end point of the polishing step.

DETAILED DESCRIPTION OF THE PREFERRED EMBODIMENTS

A scheme for detecting an end point during chemical mechanical polishing (CMP) when planarizing a wafer surface is described. In the following description, numerous specific details are set forth, such as specific structures, materials, tools, polishing techniques, etc., in order to provide a thorough understanding of the present invention. However, it will be appreciated by one skilled in the art that the present invention may be practiced without these specific details. In other instances, well known techniques, structures and processes have not been described in detail in order not to obscure the present invention. Furthermore, although the present invention is described in reference to performing CMP on a layer formed on a semiconductor wafer, the invention can be readily adapted to polish other materials as well, such as glass, metal substrates or other semiconductor substrates, including substrates for use in manufacturing flat panel displays.

Figure 1:
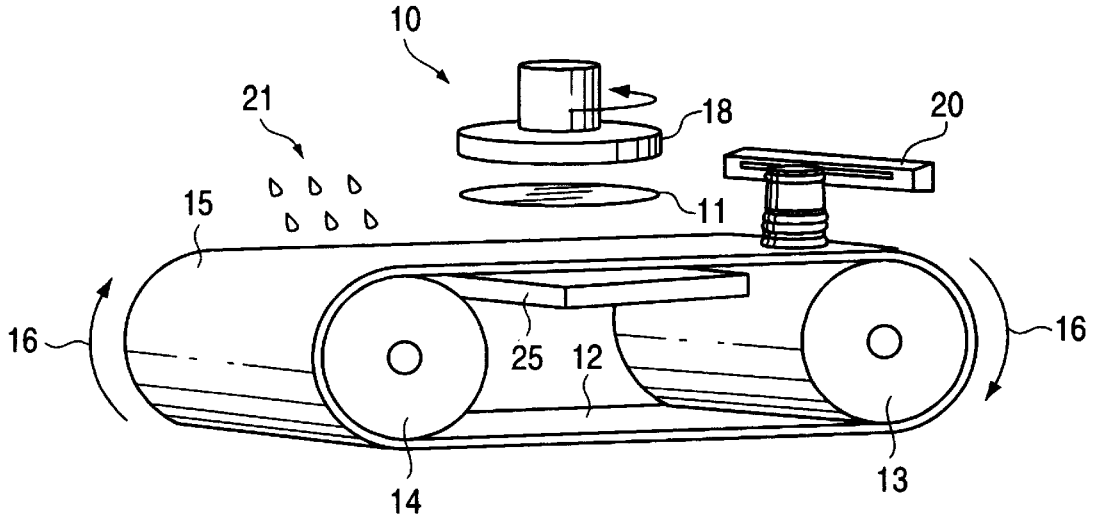
FIG. 1 is a pictorial illustration of a linear polisher which incorporates the present invention.

Referring to FIG. 1, a linear polisher 10 for use in practicing the present invention is shown. The linear polisher (also referred to as a linear planarization tool) 10 is utilized in planarizing a semiconductor wafer 11, such as a silicon wafer. Although CMP can be utilized to polish a base substrate, typically CMP is utilized to remove a material layer (such as a film layer) or a portion of the material layer deposited on the semiconductor wafer. Thus, the material being removed can be the substrate material of the wafer itself or one of the layers formed on the substrate. Formed layers include dielectric materials (such as silicon dioxide), metals (such as aluminum, copper or tungsten) and alloys, or semiconductor materials (such as silicon or polysilicon).

More specifically for IC fabrication, CMP is employed to planarize one or more of these layers fabricated on the wafer or is employed to expose an underlying topography while planarizing the surface. In many instances, CMP involves patterned features formed on the surface of a wafer. For example, a dielectric layer (such as silicon dioxide) may be deposited over the surface, covering both raised features, as well as the underlying dielectric layer. Then, CMP is used to planarize the overlying silicon dioxide, so that the surface is substantially planarized. It is desirable to stop the polishing process at a point the raised features are exposed.

In another technique, dual damascene structures are fabricated by the use of CMP. For example, via and contact trench openings are patterned and formed in an inter-level dielectric (ILD) layer residing on a semiconductor wafer. Subsequently, a metal, such as copper or aluminum, is deposited to fill in the via and trench openings. In the case of copper, a barrier layer (such as TiN, Ta, TaN, etc) is deposited into the openings first to operate as a barrier liner between the Cu and the ILD. Then, CMP is used to polish away the excess metal material residing over the ILD, so that the metal resides only in the via and trench openings. CMP allows for the surface of the contact region (upper portion of the dual opening) to have a substantially planar surface, while the metal above the surface of the ILD is removed. The formation and fabrication of dual damascene structures are known in the art.

Thus, CMP is utilized extensively to planarize film layers or formed features in which the planarization process is terminated at a particular point. In the dual damascene structure described above, the CMP is terminated when the metal is removed to expose the ILD. CMP ensures that the resultant structure has metal remaining only in the openings and that the upper surface of the ILD and the trench fill have a substantially planar surface. Generally, the art of performing CMP to polish away all or a portion of a layer formed on a wafer is known in the art.

The linear polisher 10 of FIG. 1 employs a linear planarization technology described above. The linear polisher 10 utilizes a belt 12, which moves linearly with respect to the surface of the wafer 11. The belt 12 is a continuous belt rotating about rollers (or spindles) 13 and 14, in which one roller or both is/are driven by a driving means, such as a motor, so that the rotational motion of the rollers 13, 14 causes the belt 12 to be driven in a linear motion (as shown by arrow 16) with respect to the wafer 11. The belt 12 is typically made from a metallic material. A polishing pad 15 is affixed onto the belt 12 at its outer surface facing the wafer 11. The pad can be made from a variety of materials, but is generally fibrous to provide an abrasive property. The belt can also be made from materials other than metal. In some instances, the pad 15 and the belt 12 are integrated as a single unit when fabricated. However constructed, the belt/pad assembly is made to move in a linear direction to planarize the wafer 11.

The wafer 11 typically resides within a wafer carrier 18, which is part of a polishing head. The wafer 11 is held in position by a mechanical retaining means, such as a retainer ring, and/or by the use of vacuum. Generally, the wafer 11 is rotated, while the belt/pad assembly moves in a linear direction 16 to polish a layer on the wafer 11. A downforce is exerted to press the polishing head and carrier 18 downward, in order to engage the wafer onto the pad with some predetermined force. The linear polisher 10 also dispenses a slurry 21 onto the pad 15. A pad conditioner 20 is typically used in order to recondition the pad surface during use. Techniques for reconditioning the pad 15 are known in the art and generally require a constant scratching of the pad in order to remove the residue build-up caused by the used slurry and removed waste material.

A support, platen or bearing 25 is disposed on the underside of belt 12 and opposite from the wafer 11, such that the belt/pad assembly resides between the bearing 25 and wafer 11. A primary purpose of bearing 25 is to provide a supporting platform on the underside of the belt 12 to ensure that the pad 15 makes sufficient contact with wafer 11 for uniform polishing. Since the belt 12 will depress when the wafer is pressed downward onto the pad 15, bearing 25 provides a necessary counteracting support to this downward force.

The bearing 25 can be a solid platform or it can be a fluid bearing (also referred to as a fluid platen or support). In the practice of the present invention, the preference is to have a fluid bearing, so that the fluid flow (shown by arrows 26 in FIG. 2) from the bearing 25 can be used to control forces exerted onto the underside of the belt 12. The fluid is generally air or liquid, although a neutral gas (such as nitrogen) can be used. By such fluid flow control, pressure variations exerted by the pad on the wafer can be adjusted to provide a more uniform polishing profile across the face of the wafer 11. One example of a fluid bearing is disclosed in U.S. Pat. No. 5,558,568. Another example is described in a patent application titled "Control Of Chemical-Mechanical Polishing Rate Across A Substrate Surface For A Linear Polisher;" Ser. No. 08/882,658; filed Jun. 25, 1997.

Figure 2:
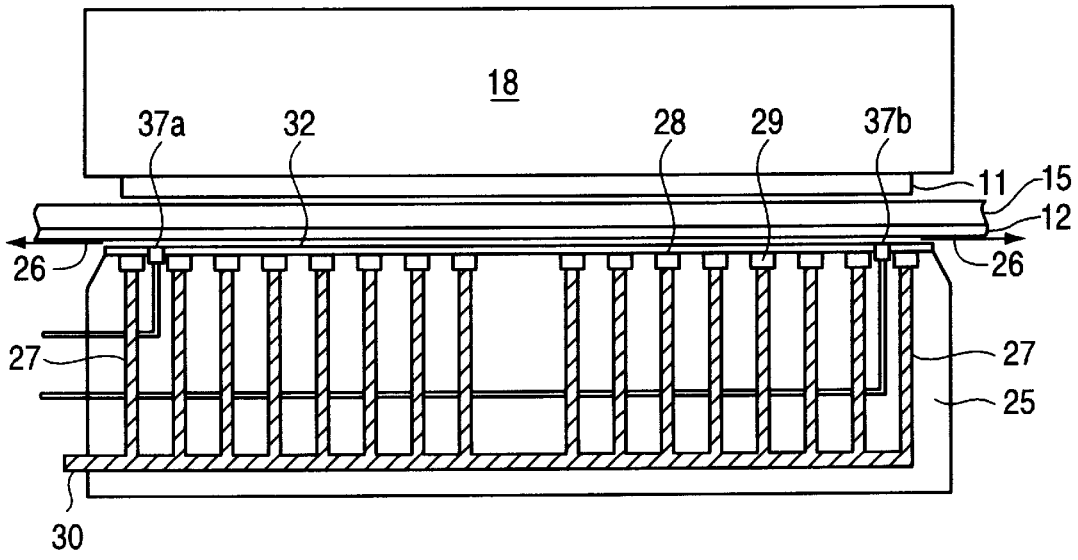
FIG. 2 is a cross-sectional view of a fluid bearing positioned under the belt/pad assembly and in which pressure sensors are disposed along the underside of the belt/pad assembly to measure pressure of the fluid residing between the underside of the belt/pad assembly and the fluid bearing.

As shown in FIG. 2, the fluid bearing 25 is positioned directly under the wafer 11, but on the opposite side of the belt 12. The wafer carrier 18 exerts a downforce to engage the wafer 11 on the pad 15, while the fluid flow from the fluid bearing exerts a counter-acting force to the underside of the belt 12. A plurality of channels 27 are distributed within the body of the bearing 25 with openings 28 disposed along the upper surface. In some instances, the channels 27 open into corresponding concentric grooves 29 formed along the upper surface region of the fluid bearing 25, so that fluid flow from a given opening 28 feeds fluid into the corresponding groove or grooves 29.

Figure 3:
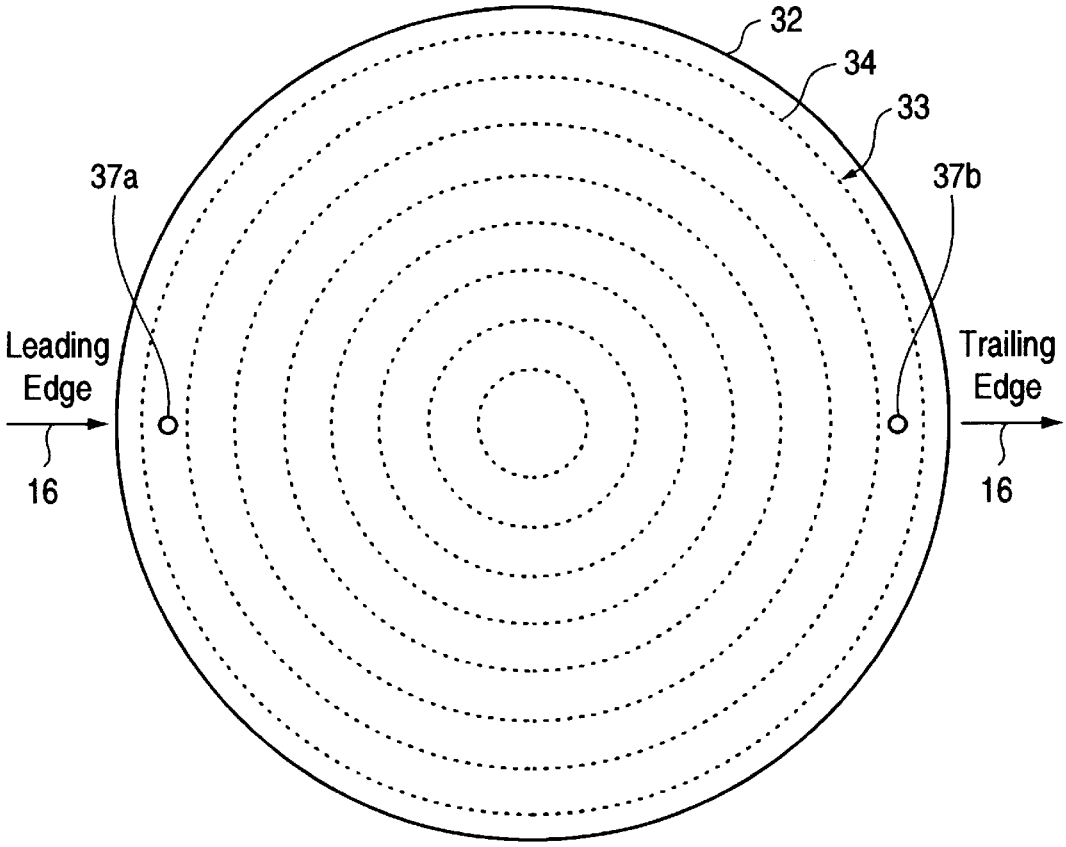
FIG. 3 is a top view of a cover plate having concentric arrangement of fluid openings for placement on the top surface of the fluid bearing of FIG. 2.

A cover plate (or insert) 32, also shown in FIG. 3, is then placed atop the bearing 25 to fit over the grooves 29. A plurality of openings 34, arranged in concentric rings 33, are distributed on the cover plate 32, so that each ring 33 coincides with a corresponding groove 29. Thus, in the example, the openings 34 of each concentrically arranged ring 33 are fed by fluid flow from the corresponding groove 29. A single inlet 30 is shown for feeding each of the channels 27. However, it is appreciated that the channels 27 could be coupled separately or in groups to separate inlets for individual (or group) flow control. FIGS. 2 and 3 show just one arrangement of openings on the surface of the bearing 25 to discharge the fluid and that the concentrically arranged openings 34 are but one example of how the openings can be configured.

In addition, by regulating or adjusting the fluid flow to the channels 27, the fluid pressure at the openings 28 can be regulated or adjusted, as well. That is, by adjusting the fluid flow at the inlet 30, fluid pressure at the openings 34 can be adjusted. The above-mentioned patent application titled "Control Of Chemical-Mechanical Polishing Rate Across A Substrate Surface For A Linear Polisher" describes a fluid bearing having adjustable fluid pressure at the openings. Furthermore, it is appreciated that each channel, a grouping of channels or portions of one or more rings can be configured for independent fluid pressure control. Thus, fluid pressure at different locations along the bearing surface can be controlled or adjusted separately. Again, although only one example is shown, a variety of fluid bearings can be implemented for the fluid bearing 25. The number of such fluid channels, openings and arrangement are design choices.

As noted previously, it is desirable to monitor the on-going process and determine at what point the polishing should be stopped. In order to provide for an end-point detection of an on-going process, the present invention uses sensors 37 to determine the end-point of a polishing process. In the example shown in FIGS. 2 and 3, the sensors are disposed within the fluid bearing 25. It is appreciated that a number of sensors 37 can be located at various sensing points along the surface of the fluid bearing or they can be located elsewhere (even away from the bearing itself), in which instance such sensors are coupled to sensing input locations along the surface of the fluid bearing by the use of electrical, hydraulic or pneumatic lines, etc.

In FIGS. 2 and 3, two sensors 37 (noted as sensors 37*a* and 37*b*) are shown disposed along the surface of the fluid bearing 25. The exact number and placement of such sensors is a design choice, but may be dependent on the type of parameters being measured or information being sought. The sensors employed can measure a variety of parameters which can provide information relating to the on-going polishing process. U.S. Pat. No. 5,762,536 describes the use of sensors for monitoring various polishing parameters. One type of sensor employed is a pressure sensor to measure the pressure exerted by the fluid flowing between the fluid bearing 25 and the underside of the belt 12.

In the example shown, two sensors 37*a–b* are shown. A leading edge sensor is labeled 37*a* and a trailing edge sensor is labeled 37*b*. The leading edge is defined as the edge of the wafer 11 first making contact with a point located on the linearly moving pad 15. Alternatively, the trailing edge is defined as the edge of the wafer 11 where the pad 15 disengages from the wafer. Thus, the leading edge sensor 37*a* is disposed near the edge where a point on the belt 12 first engages the fluid bearing 25, while the trailing edge sensor 37*b* is located at the opposite edge of the bearing 25 along the linear direction traveled by the belt 12.

In the practice of the present invention, pressure sensors are utilized for sensors 37*a–b*. During a polishing operation, the fluid flow onto the fluid bearing 25 disperses fluid along the surface of the fluid bearing 25. Since the belt 12 is within close proximity of the bearing surface, the area between the fluid bearing 25 and the underside of the belt 12 is also filled with the fluid. Adequate fluid flow ensures that this space is filled with fluid, so that pressure sensors 37 will measure the pressure of the dispersed fluid. Again, U.S. Pat. No. 5,762,536 describes the use of pressure sensors to measure fluid pressure.

It is also understood that the variations in the force exerted at a particular location during polishing will cause an increase (or decrease) in the pressure being exerted onto the fluid at that location. That is, if base parameters, such as downforce of the wafer, fluid pressure of the fluid from the fluid bearing and pad velocity remain constant, the fluid pressure will typically remain somewhat constant as well. However, if certain polishing parameters are changed, then forces acting on the wafer-pad interface can cause a pressure difference that will be sensed by the pressure sensors. The present invention utilizes this change in the fluid pressure to detect when a particular end point is reached.

Figure 4:
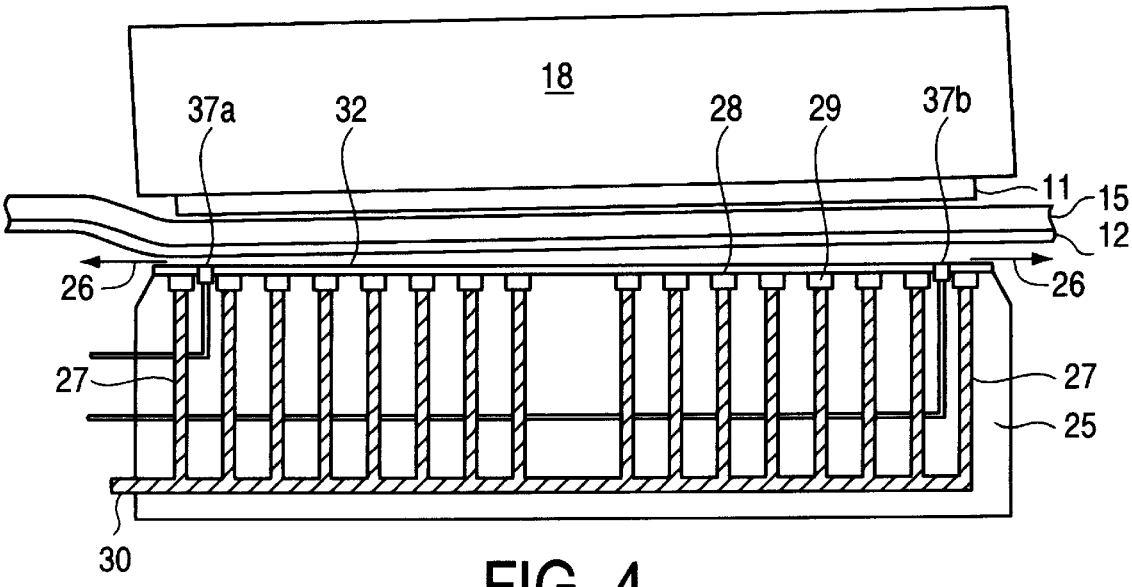
FIG. 4 is a cross-sectional view of a wafer residing above the pad and in which a change in the polishing response is noted by a leading edge sensor, when the pressure of the fluid changes at the leading edge of the wafer.

FIG. 4 illustrates one instance where there is a change in the fluid pressure. In the example of FIG. 4, the wafer 11 is shown tilted slightly so as to depress the leading edge of the pad downward towards the sensor. Assuming the other parameters had been kept constant, this slight tilt causes the fluid pressure under the leading edge region to increase. The pressure increase is noted by the leading edge sensor 37*a*. That is, changes in the pressure at the leading edge can be detected by the leading edge sensor 37*a*. In some instances, the motion of the wafer 11 may cause an increase of fluid pressure at the leading edge and a slight decrease at the trailing edge, or vice versa. Accordingly, depending on the process, some process variations can be detected by a change in the pressure at the leading edge, the trailing edge, or the pressure differential between the leading edge and trailing edge locations.

This monitoring of the increase (or decrease) in the fluid pressure can be utilized to identify certain process parameters. The present invention looks at the fluid pressure changes to detect an end point condition. It has been determined through experimentation that the pad/wafer sliding interface results in a shear force that is counteracted by a gradient in the fluid bearing pressure within the bearing-belt gap. This resulting pressure gradient is generally in the direction of belt travel, so that an increase in the shear force will increase the pressure at the leading edge region, as illustrated in the example of FIG. 4.

It has also been determined through experimentation that the shear force will depend on the material being polished. Accordingly, a change in the material being polished will change the magnitude of the shear force, which causes a change in the pressure at the leading edge of the fluid bearing. This pressure change, when appropriately monitored, can identify an end point condition. That is, when one material is polished away to reveal an underlying material of different composition (the end point of the polishing process), the shear force changes accordingly. The change in the shear force causes a change in the fluid pressure, most notably at the leading edge. This fluid pressure change is detected by the leading edge pressure sensor 37*a*. Therefore, a polishing end point can be detected by noticing a change in the fluid pressure residing above the fluid bearing 25.

Figure 5:
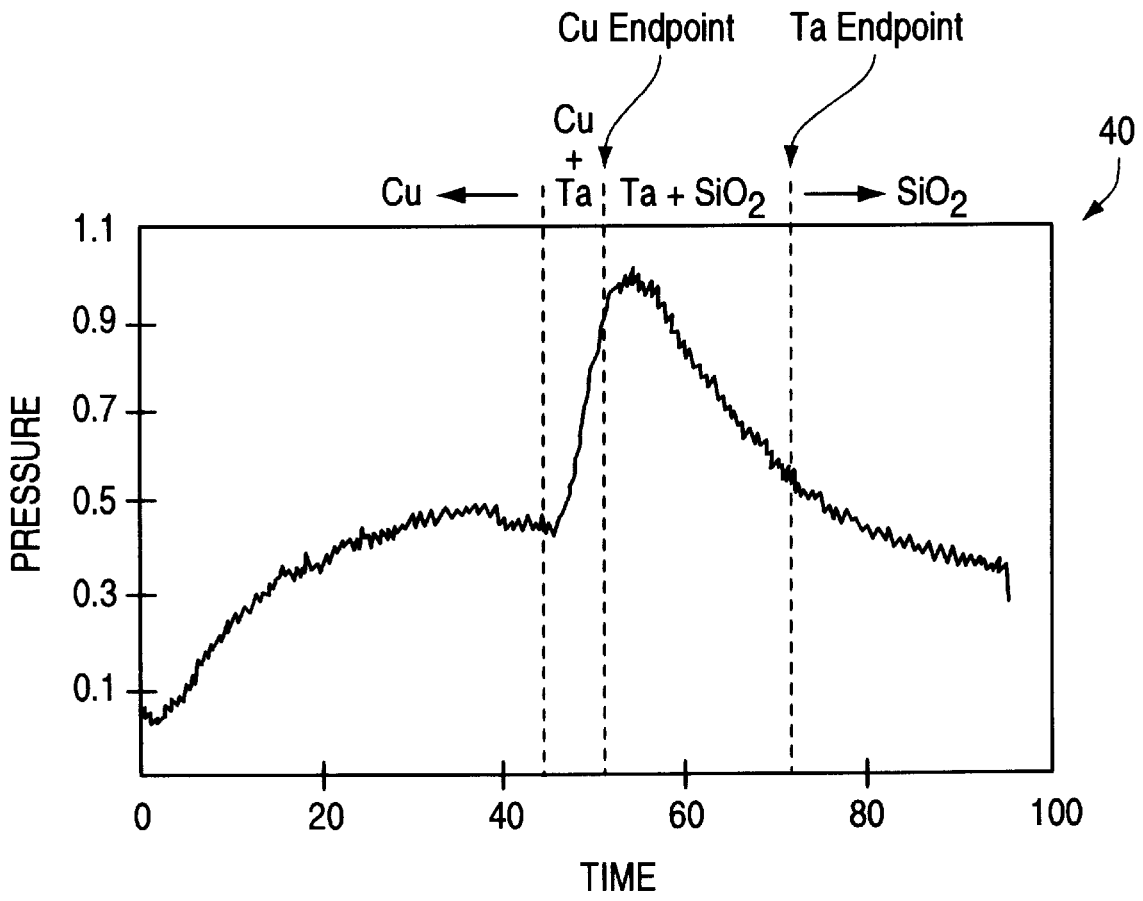
FIG. 5 is a graph showing a pressure profile measured by the leading edge sensor when different materials are polished.

Referring to a graph 40 of FIG. 5, one exemplary pressure curve for detecting a polishing process end point is illustrated. In the example experiment, a material stack comprised of copper/tantalum/silicon dioxide on a silicon wafer ($Cu/Ta/SiO_2/Si$) was polished using CMP on a linear planarization tool. Normalized fluid pressure values at the leading edge sensor 37*a* is graphed versus polishing time (arbitrary time scale is noted in the Figure). The $Cu/Ta/SiO_2/Si$ stack is equivalent to the polishing of copper (which is separated from the $SiO_2$ by a thin barrier layer of tantalum).

As noted in the graph 40, the fluid pressure increases slightly as the Cu is polished away. Then, as the underlying Ta begins to be exposed so that both Cu and Ta are being polished, a rapid increase in the fluid pressure is noted. A peak pressure is reached where only Ta is being polished. Subsequently, as Ta is polished away exposing the underlying $SiO_2$, the fluid pressure begins to decline and continues to do so until all of the Ta is removed.

It is apparent from the graph 40 that a desired polishing end point can be detected by monitoring the fluid pressure. In this instance, at the leading edge of the fluid bearing 25 by sensor 37*a*. The first abrupt change noted in the graph 40 occurs when Ta begins to be polished, culminating near a peak value when Cu has been polished away. Thus, Cu polishing end point can be determined at or near the peak fluid pressure value (as noted in the drawing). Similarly, if Ta removal is also desired, Ta polishing end point can be detected when the fluid pressure drops from the peak and reaches a preset value (also noted in the drawing). At this point, Cu and Ta will have been removed from above the ILD, so that the exposed Cu would reside in the openings formed in the ILD.

Figure 6A:
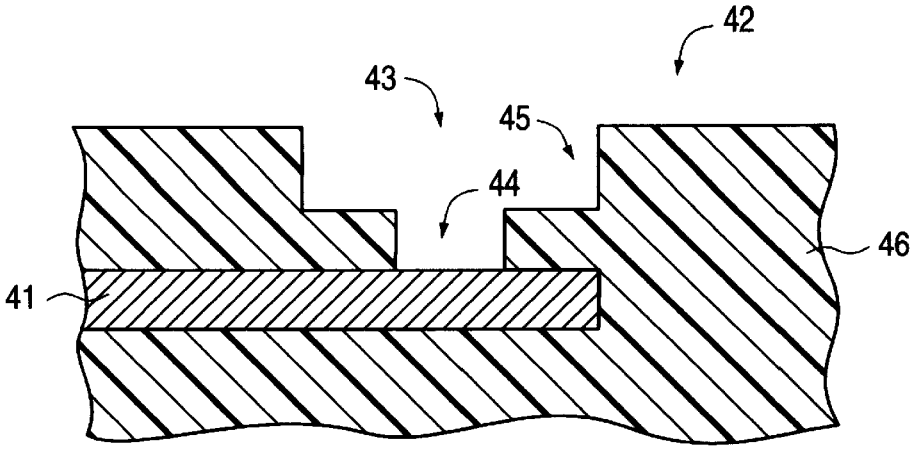
FIG. 6A is a cross-sectional view of a portion of a semiconductor device having a dual damascene structure formed in a dielectric layer and in which a via opening provides a connection to an underlying metal layer.
Figure 6B:
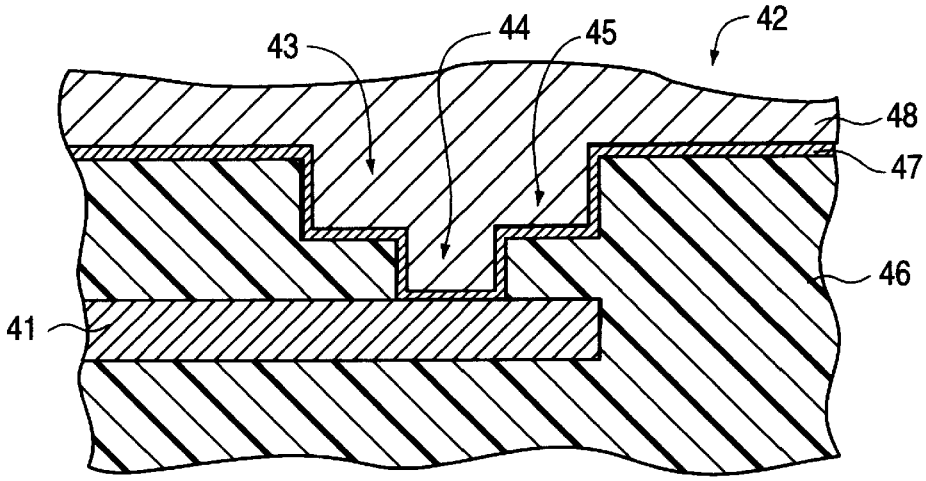
FIG. 6B is the device of FIG. 6A in which a barrier layer and a subsequent copper layer is deposited to fill trench and via openings of the dual damascene structure.
Figure 6C:
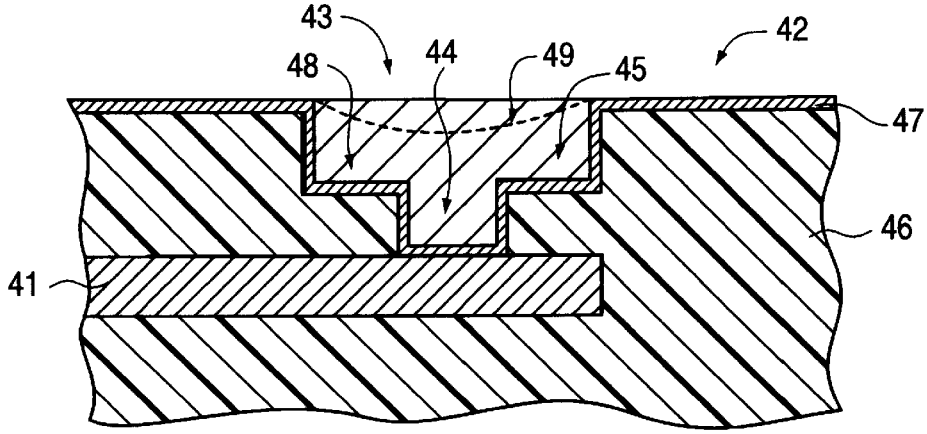
FIG. 6C is the device of FIG. 6B in which chemical mechanical polishing is employed to planarize the surface to remove excess copper and barrier material not within the trench and the via.

Referring to FIGS. 6A–C, an example application for practicing the present invention on a dual damascene structure is illustrated. In FIG. 6A, a portion of a semiconductor device 42 having a dual damascene structure 43 is shown. The dual damascene structure 43 is comprised of a via opening 44 and a contact trench opening 45 and is formed in a dielectric layer 46, which is typically referred to as an ILD. The via 44 is utilized to connect to an underlying conductive region. In the example, via 44 connects to an underlying metal layer 41.

Subsequently, a barrier layer 47 is deposited. One of the barrier materials previously described (such as TiN, Ta, TaN) is deposited as a barrier liner when copper metallization is utilized, since copper will readily diffuse into the ILD. Typically, the barrier layer is conformally deposited. Next, copper 48 is deposited over the wafer to fill in the via and trench openings 44, 45. When aluminum metallization is used, a barrier layer to isolate the metal from the ILD is typically not necessary.

Then, as shown in FIG. 6C, CMP is utilized to planarize the surface of the structure, so that the copper 48 remaining is only within the via and trench regions. Thus, the dual damascene structure is copper-filled. The CMP planarization is achieved by the practice of the linear planarization technique and the end point for the CMP is achieved by the practice of the present invention as previously described. When the copper and the barrier material are polished away, thereby exposing the underlying upper surface of the ILD, the fluid pressure changes being monitored will indicate when this end point has been reached. The CMP process is stopped. The dotted line 49 indicates what could result if the end point is not detected and the polishing is permitted to continue. The additional polishing can polish away portions of the metal residing within the trench region 45.

It is appreciated that equivalent material response graphs (like graph 40 of FIG. 5) can be experimentally obtained for the various materials being polished to detect the polishing end point. The response will also depend on the underlying material being exposed. Once experimentally obtained, the response curve can be utilized in a manufacturing setting to monitor an on-going process to detect an end point of a CMP polishing step. Accordingly, in-situ end point detection can be practiced in which the end point detection sensor is located below the polishing pad.

In the example described, two pressure sensors 37*a*, 37*b* are utilized. However, the pressure being monitored is from the leading edge sensor 37*a*. Thus, the present invention can be practiced utilizing only one sensor 37, which is located at the leading edge for optimum response. It is appreciated that the sensor 37*a* could be located elsewhere as well to provide the end point detection. However, the preference is to have it at the leading edge. The second sensor 37*b* is utilized in the present instance for providing a fluid pressure response at the trailing edge for comparison purpose with the leading edge sensor. For example, pressure differential between the two sensor locations can be monitored for polishing uniformity of a given layer. The pressure differential of the two sensors could also be used for end point detection, instead of just the leading edge sensor. The use of particular sensor or sensors and the location of such sensor(s) will depend on the polishing process being monitored.

Thus, a scheme for monitoring the fluid pressure to obtain end point detection is described. It is appreciated that the sensors of the present invention are described in reference to a pressure sensor, but other types of sensors can be readily adapted for measuring the change in the shear force or effects caused by such changes. It is also understood that the fluid bearing can be operated with air, gas or liquid. In practicing the invention, the preference is to use air or de-ionized (D.I.) water. Furthermore, although the present invention is described in reference to performing CMP on a semiconductor wafer, the invention can be readily adapted to polish other materials as well, such as glass, metal substrates or other semiconductor substrates, including substrates for use in manufacturing flat panel displays.

We claim:

1. In a tool utilized to polish a material having a planar surface and in which the planar surface is placed upon a polishing pad for polishing the planar surface, an apparatus for determining a polishing end point for polishing the planar surface comprising:

a fluid bearing disposed along an underside of the pad opposite the surface for dispensing fluid between said fluid bearing and the pad;

a sensor coupled to said fluid bearing to measure a pressure change of the fluid when the end point for polishing the planar surface is reached;

a monitor coupled with the sensor and operative to determine that the end point for polishing the planar surface is reached based on the pressure change measured by the sensor.

2. The apparatus of claim 1 wherein the planar surface is polished to expose an underlying material and in which the end point is reached when the underlying material is exposed.

3. The apparatus of claim 1 wherein said fluid bearing dispenses a liquid.

4. The apparatus of claim 1 wherein said fluid bearing dispenses air or gas.

5. In a linear polisher for performing chemical-mechanical polishing (CMP) on a surface of a substrate or a surface of a layer formed on the substrate, and in which the surface is placed upon a linearly moving polishing pad for polishing the surface, an apparatus for determining a polishing end point for polishing the surface comprising:

a fluid bearing disposed along an underside of a linearly moving belt having the pad disposed thereon, said fluid bearing for dispensing fluid along a gap between the fluid bearing and the underside of the belt;

a sensor coupled to said fluid bearing to measure a pressure change of the fluid when the end point for polishing the surface is reached;

a monitor coupled with the sensor and operative to determine that the end point for polishing the surface is reached based on the pressure change measured by the sensor.

6. The apparatus of claim 5 wherein the surface is polished to expose an underlying material and in which the end point is reached when the underlying material is exposed.

7. The apparatus of claim 6 wherein said sensor is located at a leading edge of said fluid bearing where a point on the pad first makes contact with said fluid bearing.

8. The apparatus of claim 7 wherein said fluid bearing dispenses a liquid.

9. The apparatus of claim 7 wherein said fluid bearing dispenses air or gas.

10. In a linear polisher for performing chemical-mechanical polishing (CMP) on a first material layer formed on a semiconductor wafer, and in which the first material layer is polished to expose an underlying second material layer, an apparatus for determining a polishing end point for stopping the polishing when the second material layer is exposed comprising:

a fluid bearing disposed along an underside of a linearly moving belt having the pad disposed thereon, said fluid bearing for dispensing fluid along a gap between the fluid bearing and the underside of the belt;

a sensor coupled to said fluid bearing to measure a pressure change of the fluid when the end point for polishing the first material layer is reached;

a monitor coupled with the sensor and operative to determine that the end point for polishing the first material layer is reached based on the pressure change measured by the sensor.

11. The apparatus of claim 10 wherein the pressure change is a result of a change in a shear force exerted at an interface of the pad and the first material layer and the shear force changes when the pad begins to polish the second material layer.

12. The apparatus of claim 11 wherein said sensor is located at a leading edge of said fluid bearing where a point on the pad first makes contact with said fluid bearing.

13. The apparatus of claim 12 wherein said fluid bearing dispenses a liquid.

14. The apparatus of claim 12 wherein said fluid bearing dispenses air or gas.

15. A method of determining a polishing end point for polishing a surface, comprising:

dispensing fluid along an underside of a pad or a belt upon which the pad is mounted opposite the surface being polished;

polishing the surface;

measuring a pressure change of the fluid when an end point for polishing the surface is reached;

determining that the end point for polishing the surface is reached by monitoring the measured pressure change.

16. The method of claim 15 wherein said polishing includes polishing to expose an underlying material and said measuring the pressure change measures the pressure change of the fluid when a polishing shear force changes as the underlying material is exposed.

17. The method of claim 16 wherein a sensor is coupled at a leading edge where a point on the pad first makes contact with the substrate and in which said measuring the pressure change is achieved by the sensor.

18. The method of claim 17 wherein said dispensing the fluid dispenses a liquid.

19. The method of claim 17 wherein said dispensing the fluid dispenses air or gas.

20. In a linear polisher for performing chemical-mechanical polishing (CMP) on a first material layer formed on a semiconductor wafer, and in which the first material layer is polished to expose an underlying second material layer, a method of determining a polishing end point for stopping the polishing when the second material layer is exposed, comprising the steps of:

dispensing fluid along an underside of a pad or a belt upon which the pad is mounted opposite the wafer being polished;

polishing the first material layer;

measuring a pressure change of the fluid at an end point for polishing the first material layer when the second material layer is exposed.

21. The method of claim 20 wherein said step of measuring the pressure change of the fluid includes measuring a change in a polishing shear force exerted at an interface of the pad and the first material layer and the shear force changes when the second material layer is exposed.

22. The method of claim 21 wherein a sensor is coupled at a leading edge where a point on the pad first makes contact with the wafer and in which said measuring the pressure change is achieved by the sensor.

23. The method of claim 22 wherein said dispensing the fluid dispenses a liquid.

24. The method of claim 22 wherein said dispensing the fluid dispenses air or gas.

25. In a linear polisher for performing chemical-mechanical polishing (CMP) on a surface of a substrate or a surface of a layer formed on the substrate, and in which the surface is placed upon a linearly moving polishing pad for polishing the surface, an apparatus for determining a polishing end point for polishing the surface comprising:

a fluid bearing disposed along an underside of a linearly moving belt having the pad disposed thereon, said fluid bearing for dispensing fluid along a gap between the fluid bearing and the underside of the belt;

a sensor coupled to said fluid bearing to measure a pressure change of the fluid when the end point for polishing the surface is reached;

wherein the surface is polished to expose an underlying material and in which the end point is reached when the underlying material is exposed;

wherein said sensor is located at a leading edge of said fluid bearing where a point on the pad first makes contact with said fluid bearing.

26. The apparatus of claim 25 wherein said fluid bearing dispenses a liquid.

27. The apparatus of claim 25 wherein said fluid bearing dispenses air or gas.

28. In a linear polisher for performing chemical-mechanical polishing (CMP) on a first material layer formed on a semiconductor wafer, and in which the first material layer is polished to expose an underlying second material layer, an apparatus for determining a polishing end point for stopping the polishing when the second material layer is exposed comprising:

a fluid bearing disposed along an underside of a linearly moving belt having the pad disposed thereon, said fluid bearing for dispensing fluid along a gap between the fluid bearing and the underside of the belt;

a sensor coupled to said fluid bearing to measure a pressure change of the fluid when the end point for polishing the first material layer is reached;

wherein the pressure change is a result of a change in a shear force exerted at an interface of the pad and the first material layer and the shear force changes when the pad begins to polish the second material layer;

wherein said sensor is located at a leading edge of said fluid bearing where a point on the pad first makes contact with said fluid bearing.

29. The apparatus of claim 28 wherein said fluid bearing dispenses a liquid.

30. The apparatus of claim 28 wherein said fluid bearing dispenses air or gas.

* * * * *